US012084814B2

(12) United States Patent
Yang et al.

(10) Patent No.: US 12,084,814 B2
(45) Date of Patent: Sep. 10, 2024

(54) COMPOSTABLE PAPERBOARD STRUCTURE AND METHOD FOR MANUFACTURING THE SAME

(71) Applicant: WestRock MWV, LLC, Atlanta, GA (US)

(72) Inventors: Chitai C. Yang, Mechanicsville, VA (US); Rahul Bhardwaj, Glen Allen, VA (US); Chester E. Alkiewicz, Glen Allen, VA (US)

(73) Assignee: WestRock MWV, LLC, Atlanta, GA (US)

( * ) Notice: Subject to any disclaimer, the term of this patent is extended or adjusted under 35 U.S.C. 154(b) by 218 days.

(21) Appl. No.: 17/631,489

(22) PCT Filed: Jun. 10, 2020

(86) PCT No.: PCT/US2020/036975

§ 371 (c)(1),
(2) Date: Jan. 30, 2022

(87) PCT Pub. No.: WO2021/021319

PCT Pub. Date: Feb. 4, 2021

(65) Prior Publication Data

US 2022/0275585 A1 Sep. 1, 2022

Related U.S. Application Data

(60) Provisional application No. 62/880,229, filed on Jul. 30, 2019.

(51) Int. Cl.
*D21J 1/08* (2006.01)
*D21H 17/66* (2006.01)
(Continued)

(52) U.S. Cl.
CPC ..... *D21J 1/08* (2013.01); *D21H 17/66* (2013.01); *D21H 19/40* (2013.01); *D21H 19/42* (2013.01); *D21H 19/62* (2013.01)

(58) Field of Classification Search
CPC ..... D21H 17/66; D21H 19/40; D21H 19/42; D21H 19/62; D21H 17/16; D21H 19/20;
(Continued)

(56) References Cited

U.S. PATENT DOCUMENTS 6,010,784 A * 1/2000 Peterson ..... B32B 7/12 428/354
9,744,556 B2 * 8/2017 Skupin ..... B05D 7/00
(Continued)

FOREIGN PATENT DOCUMENTS

EP 2331602 B2 * 11/2017 ..... B05D 1/265
WO WO-9853141 A1 * 11/1998 ..... C09D 167/04
(Continued)

OTHER PUBLICATIONS

Corresponding Brazilian Office Action dated Feb. 6, 2024, 55 pages.

*Primary Examiner* — Jose A Fortuna
(74) *Attorney, Agent, or Firm* — Neil G. Cohen

(57) ABSTRACT

A paperboard structure including a paperboard substrate having a first major side and a second major side opposed from the first major side, and a coating layer on the first major side, the coating layer includes a polymer and talc, wherein the polymer includes at least one of poly(butylene succinate) and poly(butylene succinate-co-adipate).

20 Claims, 9 Drawing Sheets

(51) Int. Cl.
*D21H 19/40* (2006.01)
*D21H 19/42* (2006.01)
*D21H 19/62* (2006.01)

(58) Field of Classification Search
CPC ..... D21H 19/56; D21H 19/58; D21H 19/82; D21H 19/44; D21H 19/00; D21H 17/36; D21H 17/67; D21J 1/08
See application file for complete search history.

(56) References Cited

U.S. PATENT DOCUMENTS 10,414,105 B2 * 9/2019 Räsänen ..... D21H 19/28
11,618,054 B2 * 4/2023 Mongrain ..... C09J 125/14 427/411
11,660,848 B2 * 5/2023 Knauf ..... D21H 19/82 428/201
11,821,142 B2 * 11/2023 Boswell ..... D21H 27/06
2002/0065345 A1 * 5/2002 Narita ..... C08J 5/18 428/480
2017/0008227 A1 * 1/2017 Räsänen ..... B29C 71/04
2019/0009970 A1 * 1/2019 Yang ..... D21H 19/40
2019/0291134 A1 * 9/2019 Mongrain ..... B32B 3/28
2022/0275585 A1 * 9/2022 Yang ..... D21H 17/66
2022/0290003 A1 * 9/2022 Terwillegar ..... B29C 48/154
2022/0347992 A1 * 11/2022 Knauf ..... C09D 5/00
2023/0374734 A1 * 11/2023 Bhardwaj ..... D21H 27/10

FOREIGN PATENT DOCUMENTS

WO WO-2009064052 A1 * 5/2009 ..... C08K 3/013
WO WO-2010034712 A1 * 4/2010 ..... B05D 1/265
WO WO-2013007872 A1 * 1/2013 ..... B29C 41/30
WO WO-2014064335 A1 * 5/2014 ..... B05D 1/265
WO WO-2014064340 A1 * 5/2014 ..... A47G 19/2205
WO WO-2015110980 A1 * 7/2015 ..... B29C 35/08
WO WO-2017091391 A1 * 6/2017 ..... B32B 27/08
WO WO-2017091392 A1 * 6/2017 ..... B32B 27/10
WO WO-2022192486 A1 * 9/2022 ..... B29C 48/154

* cited by examiner

COMPOSTABLE PAPERBOARD STRUCTURE AND METHOD FOR MANUFACTURING THE SAME

PRIORITY

This application claims priority from U.S. Ser. No. 62/880,229 filed on Jul. 30, 2019, the entire contents of which are incorporated herein by reference.

FIELD

This application relates to coated paperboard and, more particularly, to the addition of filler to poly(butylene succinate) and/or poly(butylene succinate-co-adipate) coatings on paperboard substrates.

BACKGROUND

In the field of packaging it is often desired to provide a packaging structure with a polymeric coating. Such polymeric coatings may impart durability, moisture resistance and other useful properties, such as heat-sealability. Recently there is increasing interest in using biopolymers for the polymer coating in such packaging structure. Examples of biopolymers include poly(butylene succinate) and poly (butylene succinate-co-adipate). However, both poly(butylene succinate) and poly(butylene succinate-co-adipate) present challenges in the extrusion coating process stability and downstream converting particularly heat-sealability.

Accordingly, those skilled in the art continue with research and development efforts in the field of paperboard manufacturing.

SUMMARY

Disclosed are paperboard structures and associated methods for manufacturing paperboard structures.

In one example, the disclosed paperboard structure includes a paperboard substrate that includes a first major side and a second major side opposed from the first major side. The paperboard structure also includes a coating layer on the first major side, wherein the coating layer includes a polymer and filler, and wherein the polymer includes at least one of poly(butylene succinate) and poly(butylene succinate-co-adipate).

In one example, the disclosed method for manufacturing a paperboard structure includes preparing a coating composition that includes a polymer and filler, wherein the polymer includes at least one of poly(butylene succinate) and poly (butylene succinate-co-adipate). The method further includes applying the coating composition to the paperboard substrate to form the coating layer on the paperboard substrate.

Other examples of the disclosed paperboard structures and methods will become apparent from the following detailed description, the accompanying drawings, and the appended claims.

DETAILED DESCRIPTION

Figure 1:
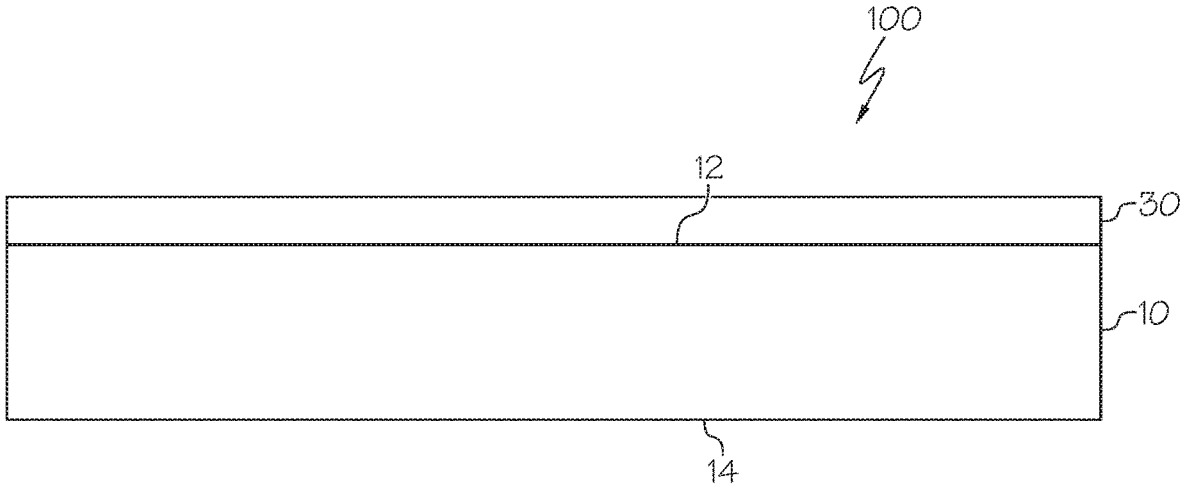
FIG. 1 is a simplified cross-sectional view of a paperboard structure having a paperboard substrate and a coating layer in accordance with the present disclosure.

The following detailed description refers to the accompanying drawings, which illustrate specific examples described by the disclosure. Other examples having different structures and operations do not depart from the scope of the present disclosure. Like reference numerals may refer to the same feature, element, or component in the different drawings.

Illustrative, non-exhaustive examples, which may be, but are not necessarily, claimed, of the subject matter according the present disclosure are provided below. Reference herein to "example" means that one or more feature, structure, element, component, characteristic and/or operational step described in connection with the example is included in at least one embodiment and/or implementation of the subject matter according to the present disclosure. Thus, the phrase "an example" and similar language throughout the present disclosure may, but do not necessarily, refer to the same example. Further, the subject matter characterizing any one example may, but does not necessarily, include the subject matter characterizing any other example.

Referring to FIG. 1, the present disclosure provides examples of a paperboard structure 100. The paperboard structure 100 includes a paperboard substrate 10 having a first major side 12 and a second major side 14 opposed from the first major side 12. The paperboard structure 100 also includes a coating layer 20 on the first major side 12 of the paperboard substrate 10. The coating layer 20 includes a polymer and filler, wherein the polymer includes at least one of poly(butylene succinate) and poly(butylene succinate-co-adipate).

Although coating layer 20 is generally shown and described as being on the first major side 12 of the paperboard substrate 10, it is generally contemplated that a coating layer 20 may also be on the second major side 14 of the paperboard substrate 10 either as an alternative to coating layer 20 on the first major side 12 of the paperboard substrate 10, or in addition to it.

The paperboard substrate 10 of the paperboard structure 100 may be (or may include) any cellulosic material that is capable of being coated, such as with the disclosed coating layer 20. The paperboard substrate 10 may be a single-ply or a multi-ply substrate, as well as bleached or unbleached. Examples of appropriate paperboard substrates include corrugating medium, linerboard, solid bleached sulfate (SBS), folding box board (FBB), and coated unbleached kraft (CUK).

Additional components, such as binders, pigments, and the like, may be added to the paperboard substrate 10 without departing from the scope of the present disclosure. Furthermore, the paperboard substrate 10 may be substantially free of plastic pigments for increasing bulk, such as hollow plastic pigments or expandable microspheres, or other chemical bulking agents. Still furthermore, the paperboard substrate 10 may be substantially free of ground wood particles.

The paperboard substrate 10 may have an uncoated basis weight of at least about 40 pounds per 3000 square feet. In one example, the paperboard substrate 10 may have an uncoated basis weight of at least 40 lb/3000 $ft^2$. In another example, the paperboard substrate 10 may have an uncoated basis weight ranging from about 85 lb/3000 $ft^2$ to about 350 lb/3000 $ft^2$. In another example, the paperboard substrate 10 may have an uncoated basis weight ranging from about 85 lb/3000 $ft^2$ to about 250 lb/3000 $ft^2$. In yet another expression the paperboard substrate 10 may have an uncoated basis weight ranging from about 100 lb/3000 $ft^2$ to about 250 lb/3000 $ft^2$.

Furthermore, the paperboard substrate 10 may have a caliper (thickness) ranging, for example, from about 8 points to about 32 points (0.008 inch to 0.032 inch). In one example, the caliper range is from about 10 points to about 24 points. In another example, the caliper range is from about 12 points to about 18 points.

One specific, non-limiting example of a suitable paperboard substrate 10 is a 13-point SBS cupstock manufactured by WestRock Company of Atlanta, Georgia Another specific, non-limiting example of a suitable paperboard substrate 10 is a 12.4-point SBS cupstock manufactured by WestRock Company. Yet another specific example of a suitable paperboard substrate 10 is an 18-point SBS cupstock manufactured by WestRock Company.

Still referring to FIG. 1, the paperboard structure 100 includes a coating layer 20 on the first major side 12 of the paperboard substrate 10. The coating layer 20 may be applied to the first major side 12 by any suitable method such as, for example, by extruding a curtain of molten coating composition onto the paperboard substrate 10. Further, the coating layer 20 may be applied at various coat weights. In an example, the coating layer 20 may have a coat weight of at least about 8 lb/3000 $ft^2$. In an example, the coating layer 20 may have a coat weight ranging from about 10 lb/3000 ft2 to about 50 lb/3000 $ft^2$. In an example, the coating layer 20 may have a coat weight ranging from about 15 lb/3000 $ft^2$ to about 40 lb/3000 $ft^2$. In an example, the coating layer 20 may have a coat weight ranging from about 20 lb/3000 $ft^2$ to about 25 lb/3000 $ft^2$. Although the total quantity of applied coating may vary as needed, it is generally contemplated that consideration would be given to the physical properties of the final paperboard structure 100 (e.g., weight, density, heat-sealability, etc.).

At this point, those skilled in the art will appreciate that an additional coating layer may also be applied to the second major side 14 of the paperboard substrate 10 (not shown). The additional coating layer may be applied, for example, using the same extrusion method employed to apply coating layer 20. Similarly, the coat weight of the additional coating layer may also vary without departing from the scope of the present disclosure.

The coating layer 20 may be applied, among other reasons, to impart heat-sealability to the paperboard structure 100. More specifically, the coating layer 20 may enable the formation of coating layer-to-paperboard substrate heat seals when the coating layer 20 is exposed to heat and/or pressure. Those skilled in the art will appreciate that good heat salability may be desirable, for example, in applications that involve forming the paperboard structure 100 into complex shapes, such as during the manufacture of paperboard cups.

The coating layer 20 includes a polymer and filler, wherein the polymer includes at least one of poly(butylene succinate) (PBS) and poly(butylene succinate-co-adipate) (PBSA). PBS is a biodegradable, semi-crystalline polyester biopolymer (as determined by ASTM D6868-11) and PBSA is a copolymer of PBS. Those skilled in the art will appreciate that PBS and PBSA may be preferred over other polymeric materials because PBS and PBSA are both biodegradable and compostable as per ASTM D6400 and EN 13432 standards. More specifically, both PBS and PBSA are capable of breaking down into carbon dioxide, water, and minerals without affecting the quality of the compost. Table 1 provides examples of suitable PBS and PBSA available from PTT MCC Biochem of Bangkok, Thailand. Additionally, it is also contemplated that the PBS and/or PBSA employed in any given example of the disclosed paperboard structure and associated method for making may be derived from at least one of petroleum-based and bio-based sources.

TABLE 1

| Trade Name | FZ71PM | FZ91PM | FD92PM |
|---|---|---|---|
| Type of Polymer | PBS | PBS | PBSA |
| Density (g/cc) | 1.26 | 1.26 | 1.24 |
| Melt Flow Rate (g/10 min) | 22 | 5 | 4 |
| Melting Point (° C.) | 115 | 115 | 84 |

PBS and PBSA may be available in a variety of different grades (based on molecular weight). As such, the melt flow rate (e.g., the ability of a material's melt to flow under pressure), which is an indirect measure of molecular weight, may vary between different grades of PBS or PBSA. A suitable polymer (which includes at least one of PBS and PBSA) may be selected based on a desired melt flow rate. Alternatively, two or more grades of PBS and/or PBSA may be blended such that the desired melt flow rate is achieved in the resulting polymer. In an example, the polymer may have a melt flow rate of about 1 gram per 10 minutes to about 100 grams per 10 minutes. In an example, the polymer has a melt flow rate of at least about 3 grams per 10 minutes. In an example, the polymer has a melt flow rate of at least about 10 grams per 10 minutes. In an example, the polymer has a melt flow rate of at least about 20 grams per 10 minutes.

The coating layer 20 includes polymer and filler. The relative concentrations of polymer and filler, however, may be varied as needed with consideration given to the processability of the resulting coating composition and the heat-sealability of the resulting coating layer 20. In one example, the coating layer 20 may include at least 1 percent by weight filler. In another example, the coating layer 20 may include at least 5 percent by weight filler. In yet another example, the coating layer 20 may include at least 10 percent by weight filler.

Fillers may be added to the polymer as a way of tailoring the coating layer 20 to a specific application. The filler may include any suitable material capable of being added to a polymer and being formed into a coating layer 20 on a paperboard substrate 10, including organic fillers, inorganic fillers, and blends of one or more of the two. Examples of suitable organic fillers may include cellulose, natural fiber, wood flour, and the like. Examples of suitable inorganic fillers may include talc, calcium carbonate, mica, diatomaceous earth, silica, clay (e.g., kaolin clay), wollastonite, pumice, zeolite, ceramic spheres, and the like. Those skilled in the art will appreciate that other organic and/or inorganic fillers may be employed without departing from the scope of the present disclosure.

A filler may be selected based on certain physical characteristics (e.g., specific gravity, aspect ratio, median particle size, etc.), and with consideration given to any processing limitations related to the processing of the paperboard structure 100. For example, a filler with a relatively small median particle size may be better suited than a filler with a relatively large median particle size for applications that involve extruding the coating layer 20 through a particularly narrow extruder output slot. In an example, the filler may have a median particle size of at most 6 micrometers. In an example, the filler may have a median particle size of at most 3 micrometers. In an example, the filler may have a median particle size of at most 1 micrometer. Those skilled in the art will appreciate that in one or more examples, the coating layer 20 may include multiple types of filler without departing from the scope of the present disclosure.

In one or more applications, talc may be particularly well suited as a filler due to the improvements to processability the addition of talc may provide. Those skilled in the art will appreciate that PBS and PBSA are typically difficult to extrude due PBS and PBSA having high viscosities even at elevated processing temperatures. Further, those skilled in the art will also appreciate that incorporating mineral fillers into molten polymers usually increases or "thickens" the base polymer viscosity. Surprisingly, talc, such as Forti-Talc® AG609 LC available from Barretts Minerals of Helena, Montana, has been found to have the opposite effect when added to PBS and/or PBSA. Without being bound by any particular theory, it is believed that incorporating talc into PBS and/or PBSA may, in fact, have a thinning or "lubrication" effect in facilitating easier flow of polymer molecules (thereby improving extrudability). However, it is also believed that while coating layers 20 that contain a relatively large percentage of talc (by weight) may exhibit superior extrudability, an excess of talc in the coating layer 20 may compromise heat-sealing performance. If used, the ratio of polymer to talc in the coating layer 20 is yet another processing factor that may be varied as needed.

Figure 2:
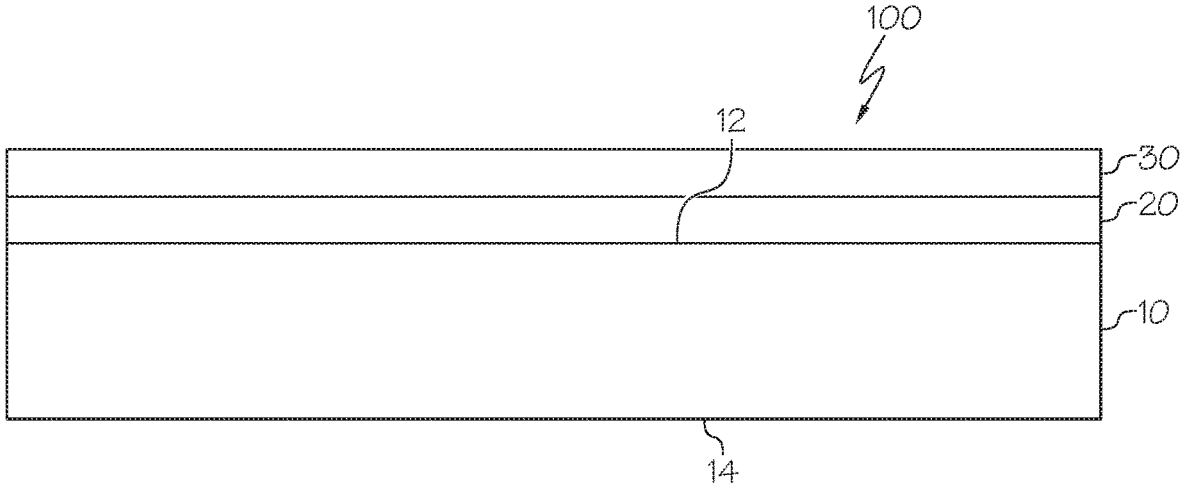
FIG. 2 is a simplified cross-sectional view of a paperboard structure having a paperboard substrate, a coating layer, and a top layer in accordance with the present disclosure.

Referring to FIG. 2, in one example, the paperboard structure 100 may include one or more top layers 30 on the first major side 12 of the paperboard substrate 10, wherein the coating layer 20 is between the paperboard substrate 10 and the top layer(s) 30. Further, in examples where the paperboard structure 100 includes a coating layer 20 on the second major side 14 of the paperboard substrate 10, it is generally contemplated that top layer(s) 30 may be similarly applied to the second major side 14 of the paperboard substrate 10 as well. The top layer(s) 30 may be applied to the paperboard substrate 10 either simultaneously (e.g., on the same machine) or separate from (e.g., after and on a separate machine) the coating layer 20. In terms of composition, the top layer(s) 30 may be similar to the coating layer 20 or entirely different. In one example, the top layer 30 may be compositionally distinct from the coating layer 20. In another example, the top layer 30 may include at least one of PBS and PBSA. In yet another example, the top layer 30 may include both PBS and PBSA.

In addition to polymer and filler, those skilled in the art will appreciate that at least one of the coating layer(s) 20 and the top layer(s) 30 may also include one or more additives, such as pigments, stabilizers and the like, without departing from the scope of the present disclosure.

Figure 3:
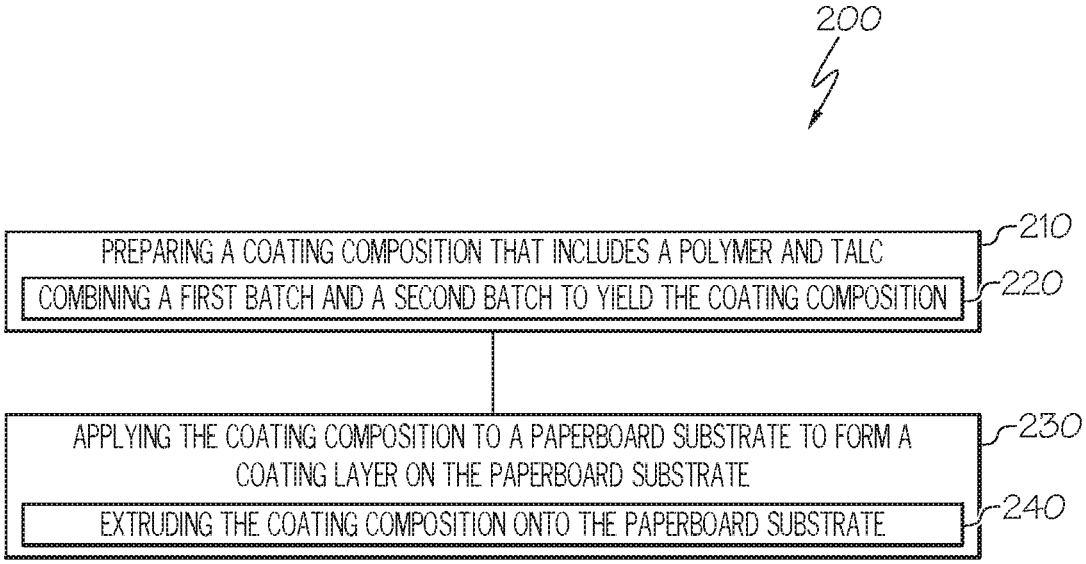
FIG. 3 is a flow diagram depicting an example of the disclosed method for manufacturing a paperboard structure.

Referring to FIG. 3, the present disclosure provides examples of a method 200 for manufacturing a paperboard structure 100. The method 200 includes preparing a coating composition that includes polymer and filler (block 210), wherein the polymer includes at least one of PBS and PBSA. Depending on the desired ratio of polymer to filler, the preparing step (block 210) may be as simple as physically combining a quantity of filler and a quantity of polymer. Alternatively, the preparing (block 210) may include other methods of combining, such as by diluting a master batch of polymer and filler. In one example, the preparing (block 210) may include combining a first batch and a second batch to yield the coating composition, wherein the first batch includes at least one of PBS and PBSA and wherein the second batch (e.g. the master batch) includes filler and at least one of PBS and PBSA (block 220). By combining the first batch and the second batch, the concentration of filler in the resulting coating composition will be less than the concentration of filler that was in the second batch.

Those skilled in the art will appreciate that the preparing step (block 210) may further include various other processing steps without departing from the scope of the present disclosure. These other processing steps may include, for example, blending a quantity of PBS and a quantity of PBSA, blending two different grades of PBS, heating the polymer, forming the coating composition into pellets, etc.

In one or more examples, the preparing (block 210) may be performed with consideration given to the rheological properties of the resulting coating composition. For example, it may be desirable to predefine rheological limits as a way of ensuring that the coating composition will be suitable for the subsequent steps of a manufacturing process (such as extrusion). In one example, the coating composition may include a shear viscosity of at least: 670 Pa·s at a shear rate of 0.01 $s^{-1}$, 240 Pa·s at a shear rate of 10 $s^{-1}$, 180 Pa·s at a shear rate of 100 $s^{-1}$, and 100 Pa·s at a shear rate of 600 $s^{-1}$. In another example, the coating composition may include a shear viscosity of about: 1,410 Pa·s at a shear rate of 0.01 $s^{-1}$, 520 Pa·s at a shear rate of 10 $s^{-1}$, 260 Pa·s at a shear rate of 100 $s^{-1}$, and 125 Pa·s at a shear rate of 600 $s^{-1}$. In yet another example, the coating composition may include a shear viscosity of at most: 670 Pa·s at a shear rate of 0.01 $s^{-1}$, 240 Pa·s at a shear rate of 10 $s^{-1}$, 180 Pa·s at a shear rate of 100 $s^{-1}$, and 100 Pa·s at a shear rate of 600 $s^{-1}$. Those skilled in the art will appreciate that the rheology of a coating composition may be determined, at least in part, by the melt flow rate of the polymer and the concentration of filler. Thus, in preparing the coating composition (block 210), these factors may be varied as needed such that the coating composition is in accordance with the predefined rheological limits.

After the coating composition has been prepared (block 210), the method 200 may then proceed to the step of applying the coating composition to a paperboard substrate 10 to form a coating layer 20 on the paperboard substrate 10 (block 230). Block 230 may be performed by any suitable method for applying a coating composition to a paperboard substrate 10. For example, block 230 may be performed by extruding the coating composition onto the paperboard substrate 10 (block 240) using the assembly shown in FIGS. 4 and 5.

Figure 4:
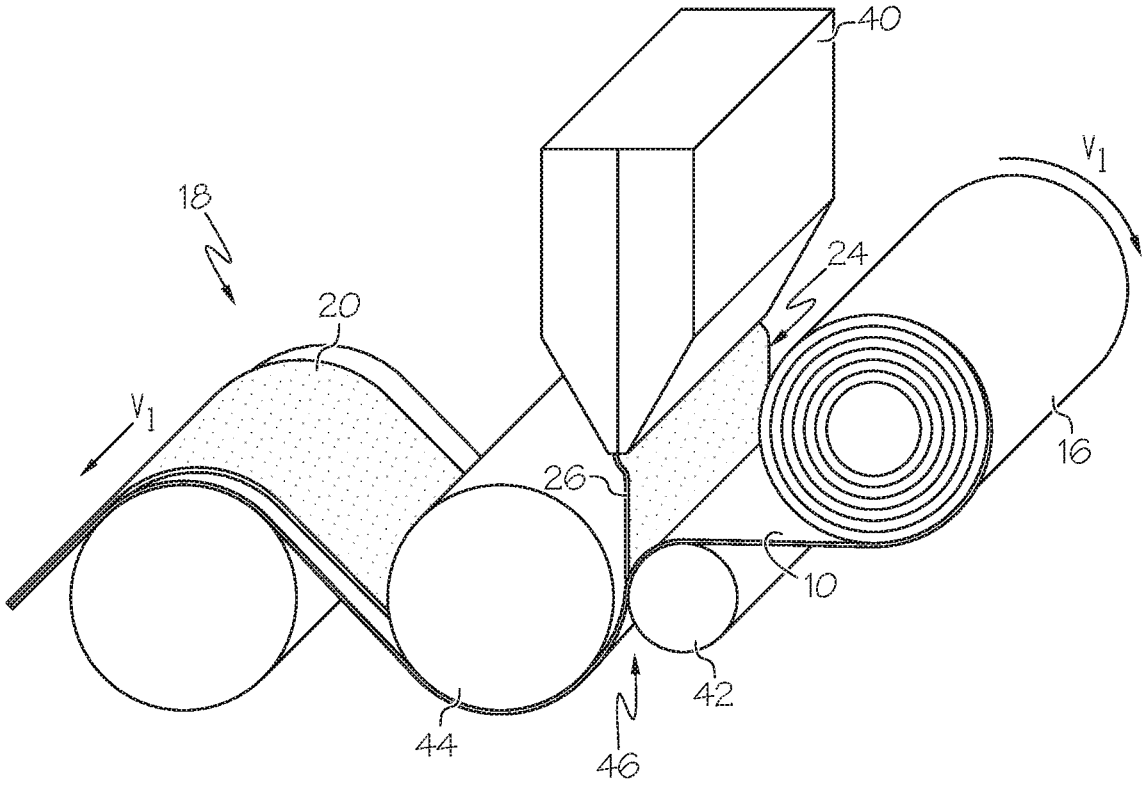
FIG. 4 is a perspective view of an extrusion coater in accordance with the present disclosure.

Referring to FIG. 4, illustrated is a simplified drawing of an extrusion coating where extruder die 40 applies a curtain 24 of polymer onto a paperboard substrate 10 as it is being unrolled from a feed roll 16. The paperboard substrate 10 and the curtain 24 are pressed together in a nip 46 between pressure roll 44 and chill roll 42, which cools the polymer before the coated paperboard substrate 18 moves onto another step in the process (e.g., curing, finishing, etc.).

Figure 5:
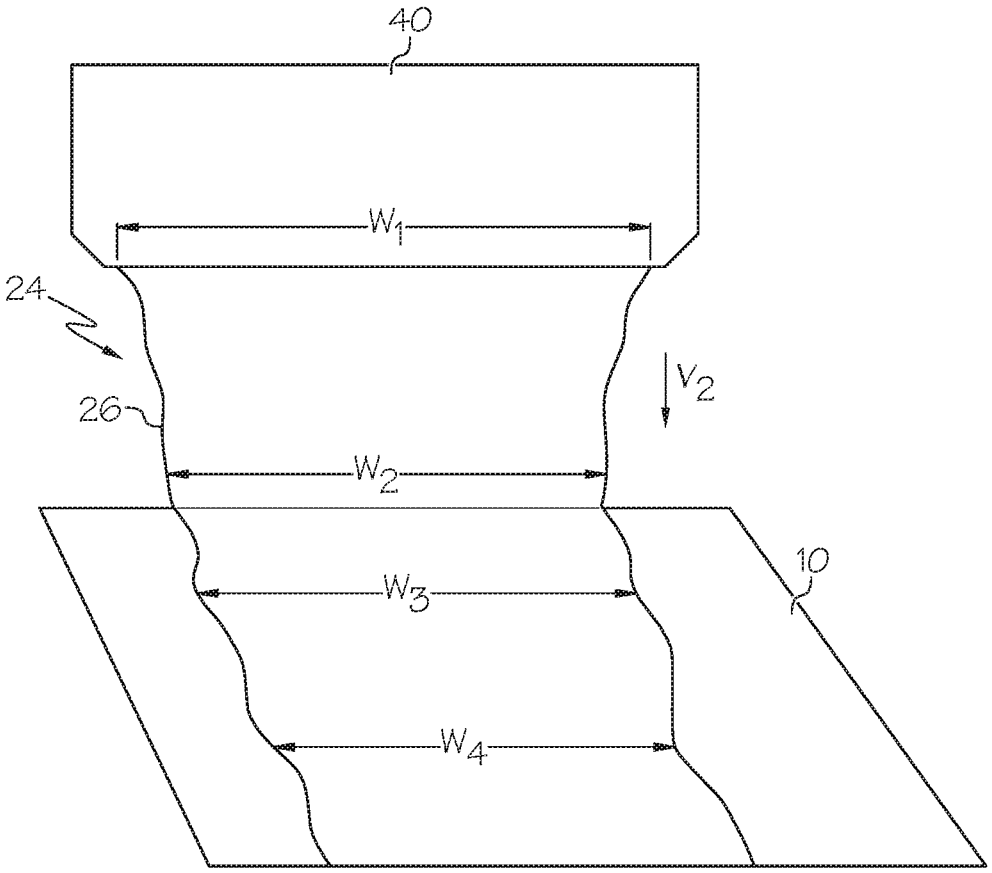
FIG. 5 is a front view of an extruded coating being applied to paperboard in accordance with the present disclosure.

Referring to FIG. 5, a front view of the extrusion coating process is shown. On leaving the extruder die 40, the curtain 24 of coating composition may have a width $W_1$ that may depend on processing conditions including composition, temperature, and feed rate of the coating composition, slot opening in the extruder die 40, and position of deckle rods within the die 40. Also dependent on these factors is the linear speed $V_2$ of curtain 24. If the slot opening is $T_1$ mils, the resulting film thickness $T_2$ of the coating composition on the coated paperboard substrate 18 will be approximately $T_1*V_2/V_1$ mils. Usually the paperboard speed $V_1$ will be several times greater than the curtain speed $V_2$, and the film thickness $T_2$ will correspondingly be several times less than $T_1$.

A processing defect that sometimes occurs and causes waste material is "edge weave," where the edges 26 of the curtain 24 waver sideways. This wavering of the curtain 24 is exhibited by wavy edges 26 on the coated paperboard substrate 18 on the paperboard substrate 10. With non-uniform coverage at the edges 26, more of the sides of the paperboard substrate 10 need to be trimmed as waste. In FIG. 5, edge weave is depicted in a simplistic manner by the wavy edge 26 of the coating, and the fact that the coated width may vary along the length of the paperboard substrate 10 as depicted by widths $W_3$ and $W_4$.

Example 1

Table 2 shows the coating compositions and coat weights for four different Samples of the disclosed paperboard structure 100.

TABLE 2

| Sample | Coating Composition (by weight) | Coat Weight (lb/3000 ft$^2$) |
|---|---|---|
| 1 | 100% PBS | 25 |
| 2 | 100% PBS | 20 |
| 3 | 10% Talc + 90% PBS | 25 |
| 4 | 10% Talc + 90% PBS | 20 |

All four Samples contain FZ71PM PBS. Notably, Samples 1 and 2 contain no talc whereas Samples 3 and 4 contain 10% by weight talc. To manufacture these Samples, pellets of the various coating compositions (shown in Table 2) were prepared and then fed into a screw extruder having the configuration shown in Table 3.

TABLE 3

| | |
|---|---|
| BZ1 | 400° F. |
| BZ2 | 425° F. |
| BZ3 | 450° F. |
| BZ4 | 450° F. |
| SC | 450° F. |
| Adapter | 450° F. |
| Feed Pipes | 450° F. |
| Dies | 450° F. |

Once molten, the coating composition was then extruded via a curtain coating arrangement onto 18-point SBS paperboard substrate. The curtain coating arrangement was configured to have a slot size of 30 in×0.025 in, an airgap of 4.5 in, and die deckles at 22 in. The screw of the extruder was set at 80 rpm for all four samples. The line speeds (e.g., $V_1$) were varied to achieve coat weights of 20 lb/3000 ft$^2$ and 25 lb/3000 ft$^2$. Additional processing conditions related to the extrusion of the coating compositions of Table 2 are summarized in Table 4.

TABLE 4

| | Sample 1 | Sample 2 | Sample 3 | Sample 4 |
|---|---|---|---|---|
| Melt Temperature (° F.) | 461 | 462 | 464 | 465 |
| Extruder Head Pressure (psi) | 2000 | 2000 | 1860 | 1860 |
| Extruder Motor Load (%) | 44 | 44 | 42.5 | 42.5 |
| Average Coat Width (in) | 18.93 | 18.81 | 17.99 | 17.87 |
| Coat Width Std. Dev. (in) | 0.108 | 0.117 | 0.021 | 0.021 |

Figure 6:
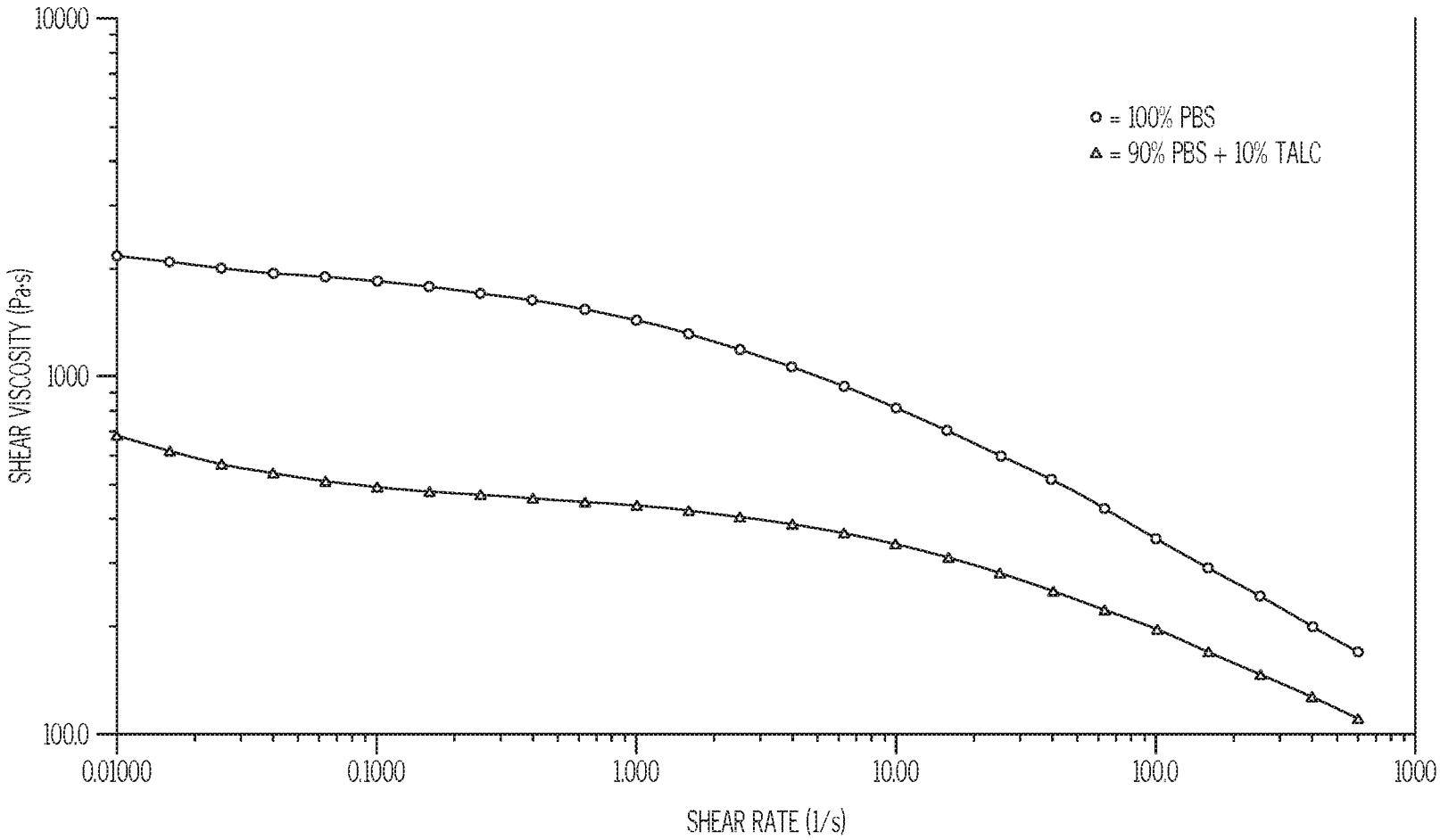
FIG. 6 is a graphical representation of shear viscosity versus shear rate of 100% PBS and 90% PBS+10% talc.

To evaluate the effect that the addition of talc has on the rheology of the coating composition, extrudates of the Sample 1-4 coating compositions were collected at the extruder die exit and measured on a parallel-plate type rheometer, Model No. AR2000ex available from TA Instruments of New Castle, Delaware, at 185° C. Referring to FIG. 6, which plots the shear viscosity values on the Y axis and shear rate on the X axis, it is shown that the addition of 10% by weight talc improves PBS extrusion processing by significantly reducing the overall viscosity of the coating composition, especially at near-zero or low shear rate conditions (e.g., less than 10 $s^{-1}$).

After being manufactured, Samples 1-4 were evaluated for edge weave and heat-sealability. The results are graphically illustrated in FIGS. 7, 8 and 9.

Figure 7:
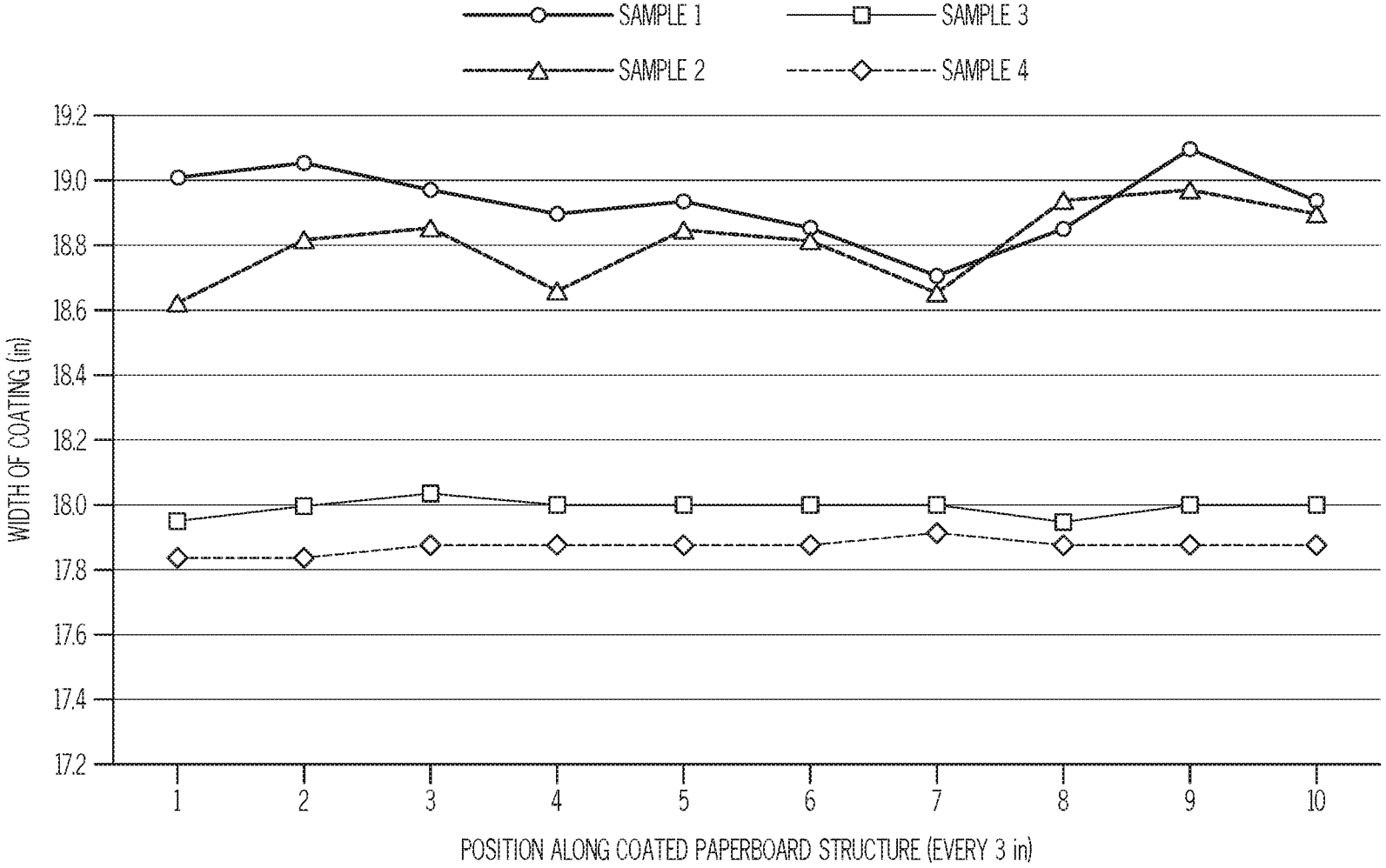
FIG. 7 is a graphical representation of the width of a coated portion of a paperboard substrate at various positions along the paperboard substrate.

Referring to FIG. 7, the effect that talc addition has on edge weave is shown. More specifically, the width of the coated portion of the paperboard substrate (which correlates to the width of the curtain) was measured at positions 1-10, wherein each position is sequentially spaced apart in three-inch intervals. The positions are plotted on the X axis and the widths of the coated portion of the paperboard substrate are plotted on the Y axis. As shown, Sample 1 ranges between 18.70 inches and 19.09 inches in width, Sample 2 ranges between 18.62 inches and 18.98 inches in width, Sample 3 ranges between 17.95 inches and 18.03 inches in width, and Sample 4 ranges between 17.83 inches and 17.91 inches in width. Thus, the addition of 10% talc significantly reduces the edge weave in the curtain.

Figure 8:
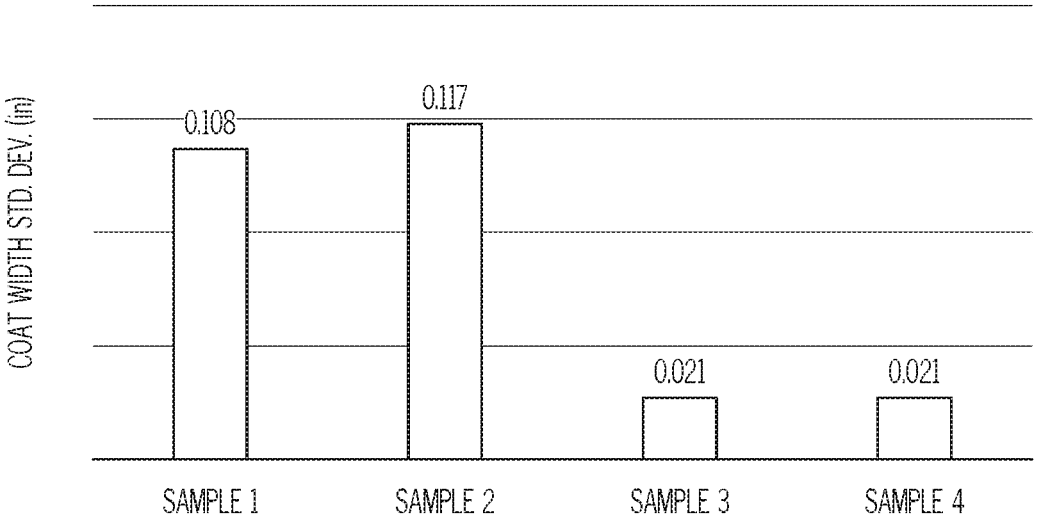
FIG. 8 is a graphical representation of the standard deviations of the average curtain width of the coating compositions associated with Samples 1-4 as they are being extruded.

From the data shown in FIG. 7, an average curtain width and the standard deviation of the curtain width were calculated. Referring to FIG. 8, which compares the standard deviations of the average curtain widths of Samples 1-4, it is shown that the addition of 10% by weight talc was able to lower the standard deviation of the average curtain widths by 0.087 inches at a coat weight of 25 lb/3000 ft$^2$ and by 0.096 inches at a coat weight of 20 lb/3000 ft$^2$.

Figure 9:
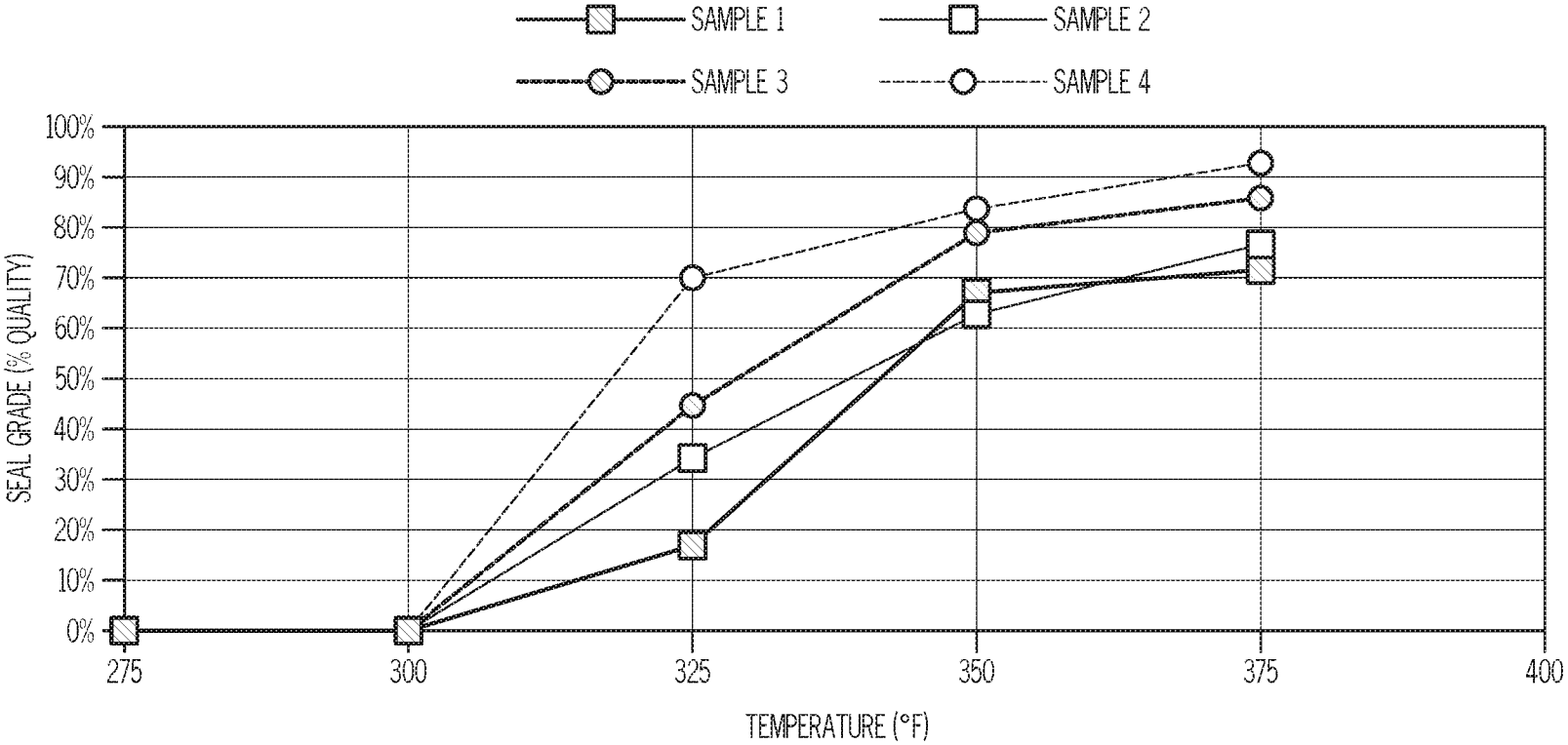
FIG. 9 is a graphical representation of percent fiber tear versus temperature of Samples 1-4.

Referring to FIG. 9, the effect that talc addition has on heat-sealability is shown (as graded by percent fiber tear). To evaluate heat-sealability, heat seals were created on Samples 1-4 using a SencorpWhite Ceratek bar sealer, available from SencorpWhite of Hyannis, Massachusetts, under 60 psi pressure, 3 second dwell time and at 325° F., 350° F. and 375° F. heat seal bar temperatures. The heat seal was evaluated pursuant to the standards and conditions set forth in TAPPI T539 test method.

FIG. 9 plots percent fiber tear on the Y axis and temperature on the X axis. In general, it shows that increasing the heat seal temperature and increasing the coat weight from 20 lb/3000 $ft^2$ to 25 lb/3000 $ft^2$ are two viable ways to improve heat sealing performance. Further, in comparing Samples 1 and 2 to Samples 3 and 4, FIG. 9 shows that the addition of 10% by weight talc improves heat-sealing performance of the coating layer at 325° F., 350° F. and 375° F. by about 10% to about 35%. Thus, the disclosed paperboard structure may include a coating layer-to-paperboard substrate heat seal with at least 40% fiber tear at 325° F., 70% fiber tear at 350° F. and 80% fiber tear at 375° F. Surprisingly, even Sample 4 (which contains talc) exhibited better heat-sealing performance than Sample 1 (which does not contain talc) at every temperature tested, even though Sample 1 had a greater coat weight than Sample 4.

Example 2

Table 5 provides the coating compositions used to form five different Extrudate Samples (ES).

TABLE 5

| | Coating Composition (by weight) |
|---|---|
| ES 1 | 100% FZ91PM |
| ES 2 | 80% FZ91PM + 20% FZ71PM |
| ES 3 | 75% FZ91PM + 15% FZ71PM + 10% Talc |
| ES 4 | 100% FZ71PM |
| ES 5 | 90% FZ71PM + 10% Talc |

Extrudate Samples 1-3 contain FZ91PM, Extrudate Samples 3-5 contain FZ71PM, and Extrudate Samples 3 and 5 contain talc. These Extrudate Samples were prepared by feeding the coating compositions of Table 5 into a screw extruder having the configuration shown in Table 6.

TABLE 6

| | |
|---|---|
| BZ1 | 400° F. |
| BZ2 | 450° F. |
| BZ3 | 475° F. |
| BZ4 | 475° F. |
| SC | 475° F. |
| Adapter | 475° F. |
| Feed Pipes | 475° F. |
| Dies | 475° F. |

Screw speeds were run at 80 rpm, the line speed was kept at 140 feet per minute and the air gap was maintained at 4.5 inches. The coating compositions of Table 5 were melted in the screw extruder and then extruded. Additional processing conditions related to the extrusion of the coating compositions of Table 5 are summarized in Table 7.

TABLE 7

| | ES 1 | ES 2 | ES 3 | ES 4 | ES 5 |
|---|---|---|---|---|---|
| Melt Temperature (° F.) | 504 | 503 | 500 | 483 | 484 |
| Extruder Head Pressure (psi) | 2200 | 1900 | 1800 | 1720 | 1680 |
| Extruder Motor Load (%) | 54 | 52 | 49 | 42.5 | 42 |
| Average Coat Width (cm) | n/a | n/a | 49.40 | 44.14 | 39.10 |
| Coat Width Std. Dev. (in) | n/a | n/a | 0.100 | 0.092 | 0.075 |

Extrudate Samples 1-5 were collected at the extruder die exit and measured on a parallel-plate type rheometer, Model No. AR2000ex available from TA Instruments of New Castle, Delaware, at 185° C. The shear viscosities of Extrudate Samples 1-5 over a range of shear rates are summarized in Table 8.

TABLE 8

| | Shear Viscosity (Pa · s) | | | | |
|---|---|---|---|---|---|
| Shear Rate ($s^{-1}$) | ES 1 | ES 2 | ES 3 | ES 4 | ES 5 |
| 0.01 | 41450 | 22890 | 6216 | 2160 | 687 |
| 10 | 2761 | 2248 | 1156 | 817 | 252 |
| 63 | 1065 | 867 | 531 | 429 | 223 |
| 100 | 806 | 665 | 427 | 351 | 198 |
| 251 | 439 | 410 | 267 | 244 | 146 |
| 600 | 269 | 249 | 179 | 169 | 111 |

Figure 10:
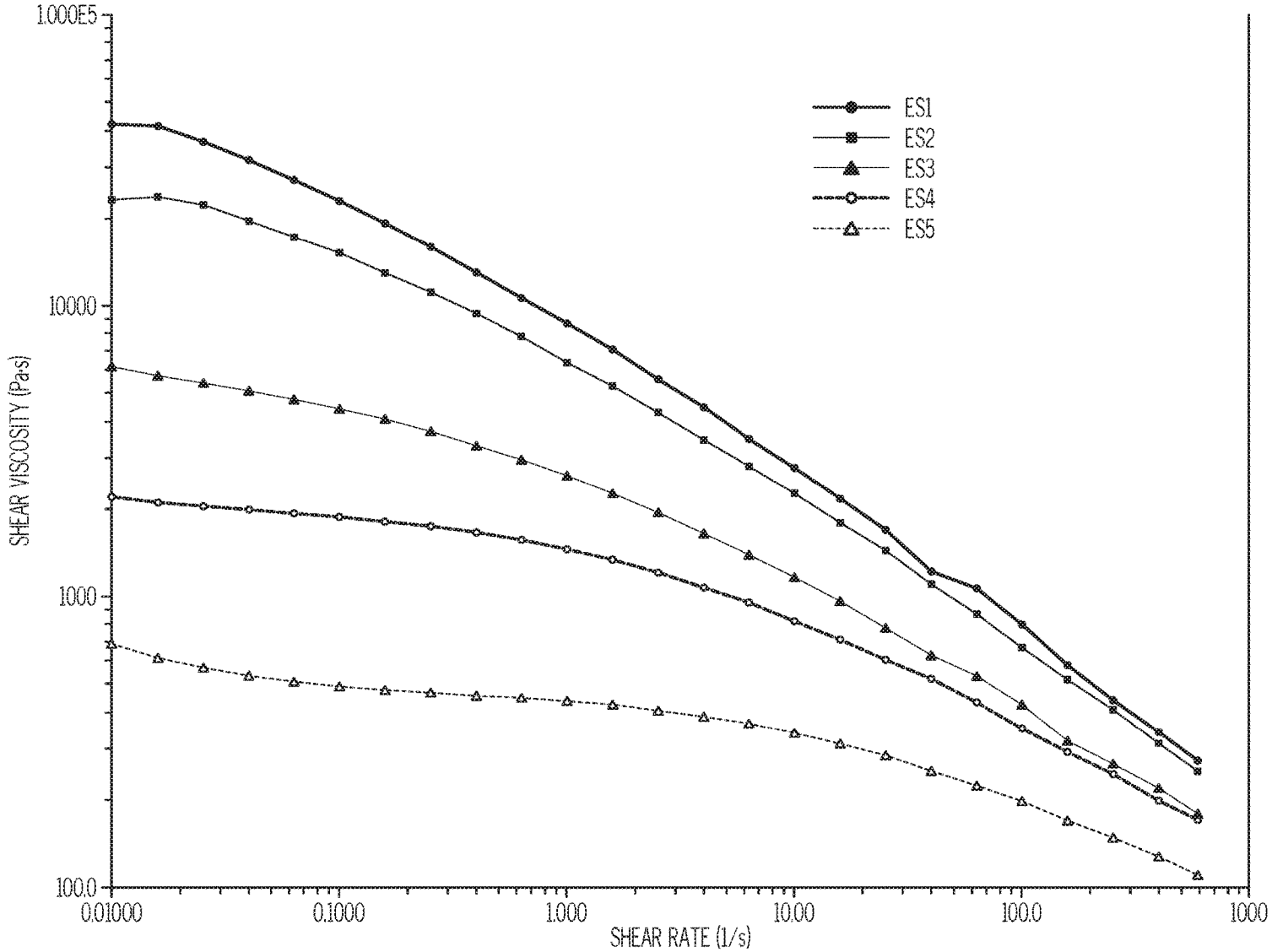
FIG. 10 is a graphical representation of shear viscosity versus shear rater of Samples 1-5.

Referring to FIG. 10, which plots shear viscosity on the Y axis and shear rate on the X axis, the rheological profiles of Extrudate Samples 1-5 is shown. As expected, the Extrudate Samples exhibited higher viscosities and greater differences between viscosities at lower shear rates than at higher shear rates. The addition of 20% by weight FZ71PM to FZ91PM helped to reduce the viscosity of the resulting coating composition by almost half at low shear rates (as compared to pure FZ91PM), but ultimately proved too viscous to be feasibly extruded. The addition of 10% by weight talc to 15% by weight FZ71PM and 75% by weight FZ91PM, however, made the three-component blend extrudable by reducing the viscosity and improving extrusion processability. Similarly, the addition of 10% by weight talc to 90% by weight FZ71PM reduced the shear viscosity of the resulting coating composition by more than half at low shear rates (as compared to pure FZ71PM).

Although various aspects of the disclosed paperboard structures and associated methods have been shown and described, modifications may occur to those skilled in the art upon reading the specification. The present application includes such modifications and is limited only by the scope of the claims.

What is claimed is:

1. A paperboard structure comprising:

a paperboard substrate comprising a first major side and a second major side opposed from said first major side; and a coating layer on said first major side, said coating layer comprising a polymer and filler, wherein said polymer is a semi-crystalline polymer consisting essentially of at least one of poly(butylene succinate) and poly(butylene succinate-co-adipate).

2. The paperboard structure of claim 1 wherein said coating layer has a coat weight of at least about 8 lb/3000 $ft^2$.

3. The paperboard structure of claim 1 wherein said coating layer has a coat weight ranging from about 10 lb/3000 $ft^2$ to about 50 lb/3000 $ft^2$.

4. The paperboard structure of claim 1 wherein said coating layer is heat-sealable.

5. The paperboard structure of claim 1 wherein said polymer consists essentially of poly(butylene succinate).

6. The paperboard structure of claim 1 wherein said polymer consists essentially of poly(butylene succinate-co-adipate).

7. The paperboard structure of claim 1 wherein said polymer consists essentially of both poly(butylene succinate) and poly(butylene succinate-co-adipate).

8. The paperboard structure of claim 1 wherein said polymer has a melt flow rate of at least about 3 grams per 10 minutes.

9. The paperboard structure of claim 1 wherein said polymer has a melt flow rate of at least about 20 grams per 10 minutes.

10. The paperboard structure of claim 1 wherein said polymer is compostable.

11. The paperboard structure of claim 1 wherein said polymer is biodegradable.

12. The paperboard structure of claim 1 wherein said filler comprises an inorganic filler.

13. The paperboard structure of claim 1 wherein said filler comprises an organic filler.

14. The paperboard structure of claim 1 wherein said filler has a median particle size of at most 6 micrometers.

15. The paperboard structure of claim 1 wherein said filler has a median particle size of at most 1 micrometer.

16. The paperboard structure of claim 1 wherein said coating layer comprises at least 5 percent by weight of said filler.

17. The paperboard structure of claim 1 further comprising a top layer on said first major side, wherein said coating layer is between said paperboard substrate and said top layer.

18. The paperboard structure of claim 1 comprising a coating layer-to-paperboard substrate heat seal with at least 40 percent fiber tear when sealed with a heat seal bar temperature of 325° F. under a 60 psi seal pressure at a 3.0 second dwell time.

19. The paperboard structure of claim 1 wherein said polymer consists of at least one of poly(butylene succinate) and poly(butylene succinate-co-adipate).

20. A method for manufacturing a paperboard structure comprising:

preparing a coating composition comprising a polymer and filler, wherein said polymer is a semi-crystalline polymer consisting essentially of at least one of poly (butylene succinate) and poly(butylene succinate-co-adipate); and applying said coating composition to a paperboard substrate to form a coating layer on said paperboard substrate.

* * * * *